US005244163A

United States Patent [19]

Matsuo et al.

[11] Patent Number: 5,244,163

[45] Date of Patent: Sep. 14, 1993

[54] CONSTRUCTION OF SUPPORTING SHAFT OF ROLL OF PAPER

[75] Inventors: Takeshi Matsuo, Higashi-Osaka; Mitsutoshi Takemoto, Yao; Koji Izumi, Toyonaka; Hiroshi Kajita, Kobe, all of Japan

[73] Assignee: Mita Industrial Co., Ltd., Osaka, Japan

[21] Appl. No.: 668,095

[22] Filed: Mar. 12, 1991

[30] Foreign Application Priority Data

Mar. 19, 1990 [JP] Japan ..... 2-070810
Jul. 10, 1990 [JP] Japan ..... 2-183451

[51] Int. Cl.[5] ..... B65H 65/00; B65H 67/00; B65H 19/10

[52] U.S. Cl. ..... 242/68.4; 242/72 R

[58] Field of Search ..... 242/68, 68.4, 68.5, 242/72 R, 68.2, 55.2

[56] References Cited

U.S. PATENT DOCUMENTS

| | | | |
|---|---|---|---|
| 1,138,675 | 5/1915 | Lockwood | 242/72 R |
| 1,337,017 | 4/1920 | Kenworthy | 242/72 R |
| 1,573,183 | 2/1926 | Mehlum | 242/72 R |
| 1,658,799 | 2/1928 | DeVogel | 242/72 R |
| 1,977,668 | 10/1934 | Dallas | 242/72 R |
| 2,499,869 | 3/1950 | Luchansky | 242/72 R |
| 3,922,082 | 11/1975 | Cavallaro | 355/3 R |
| 4,541,710 | 9/1985 | McLeish | 355/13 |

FOREIGN PATENT DOCUMENTS

| | | |
|---|---|---|
| 0429303 | 5/1991 | European Pat. Off. . |
| 0448051 | 9/1991 | European Pat. Off. . |
| 2743967 | 5/1979 | Fed. Rep. of Germany . |
| 2939287 | 4/1981 | Fed. Rep. of Germany . |

OTHER PUBLICATIONS

Patent Abstracts of Japan, vol. 8, No. 240 (M-336)(1677) 6 Nov. 1984Pand Jp-A-59 118 647 (Fuji Xerox) 9 Jul. 1984 * abstract *.

*Primary Examiner*—Daniel P. Stodola
*Assistant Examiner*—John Q. Nguyen
*Attorney, Agent, or Firm*—Wenderoth, Lind & Ponack

[57] ABSTRACT

A supporting shaft of a paper roll supports the paper roll and is supported by first to third supporting elements contacting internally an inner circumferential surface of a core cylinder of the paper roll at three circumferentially spaced points, as seen in a longitudinal direction of the core cylinder. A first supporting member provided with the first supporting element and a second supporting member provided with the second supporting element are fixed in opposition to each other by means of a short and small size core shafts or spindles provided at opposite longitudinal ends of the two supporting members. Since the shafts fixedly mounting the first and second supporting members are of small size, the paper roll supporting shaft can be reduced in weight, assembly can be improved, cost of production can be reduced.

40 Claims, 10 Drawing Sheets

CONSTRUCTION OF SUPPORTING SHAFT OF ROLL OF PAPER

BACKGROUND OF THE INVENTION

1. Field of the Invention

The present invention relates to a construction of a supporting shaft for supporting a roll of paper.

2. Description of the Prior Art

Some types of image forming apparatus, such as copying machines, various kinds of printers and the like employ, a long length of paper rolled around a core cylinder, that is a so-called roll of paper or paper roll. A known supporting shaft 99 for supporting this roll of paper touches internally an inner circumferential surface S of a core cylinder 96 of the roll of paper at three points as seen in the direction of a longitudinal axis, as shown in FIG. 15 and FIG. 16. Such supporting shaft includes a supporting member 91 having a first supporting element (d) and a second supporting element (e) and two flat plate members 92 fixedly mounted on a spindle or core shaft 93. An arm 95 extending in the direction of the axis of core shaft 93 is pivoted by a supporting shaft 94 extending orthogonal to such axis to midway portions in the longitudinal direction of flat plate members 92. A saw-toothed third supporting element (f) located adjacent shaft 94 is located on arm 95. Energizing means 97 urges arm 95 and thereby third supporting piece (f) against the inner circumferential surface S of core cylinder 96. Reference numeral 98 designates a balancer.

With the above described construction, paper roll supporting shaft 99 can be inserted into and drawn out the core cylinder 96 by moving the arm 95 toward the core shaft 93 against the force of energizing means 97.

Also known is a construction in which the above described arm 95 is omitted and outer end edges of the flat plate members 92 are used as the third supporting element so that such end edges may be engaged with inner circumferential surface S of core cylinder 96. In such case, the core cylinder is supported at substantially three points by pushing the supporting shaft into the core cylinder.

However, in all of the above described constructions, the number of parts and assembly time required are increased, and also the weight of the overall structure is increased. In particular, the core shaft 93 is heavy and it is necessary to reduce the weight thereof.

Separately from the above described problems, a disadvantage of such known construction is that the position of contact of third supporting element (f) with surface S limited and occurs only in the vicinity at which the arm 95 is pivoted. Thus, opposite longitudinal ends of the core cylinder 96 are not supported by third supporting element (f) and are apt to be swung in radial directions about the third supporting element (f) as a fulcrum. As a result, drawing out and supply of paper from the paper roll will not be stable and thus poor paper supply, such as an oblique paper supply, is apt to occur.

SUMMARY OF THE INVENTION

The present invention has been achieved in view of the above described problems, and it is an object of first and second aspects of the invention to provide a construction of a supporting shaft for a paper roll which is light of weight and easy to assemble.

It is an object of a third aspect of the invention to provide a construction of a supporting shaft capable of preventing a paper roll from tilting or swinging in a radial direction, thereby to enable smooth paper supply from the paper roll, by an improvement of a third supporting element.

In order to achieve the above first described object, a construction of a supporting shaft for a paper roll according to the first aspect of the invention, wherein the paper roll is supported by means of first to third supporting elements contacting internally an inner circumferential surface of a core cylinder of the paper roll at three circumferentially spaced positions as viewed in a longitudinal direction of the core cylinder, is characterized in that a first supporting member provided with the first supporting element and a second supporting member provided with the second supporting element are fixed in opposition to each other by means of short or small size core shafts or spindles provided at opposite longitudinal ends of the two supporting members.

A construction of a supporting shaft for a paper roll according to the second aspect of the invention is characterized in that a first supporting member includes the first and a part of the third supporting elements formed by bending a flat plate, and a second supporting member includes the second and another part of the third supporting elements formed by bending another flat plate. Such two members are fixed in opposition to each other by means of short or small size core shafts or spindles provided at opposite longitudinal ends of the two supporting members.

In order to achieve the second described object, a construction of a supporting shaft for a paper roll according to the third aspect of the invention, wherein the paper roll is supported by means of first to third supporting elements contacting internally an inner circumferential surface of a core cylinder of the paper roll at three circumferentially spaced positions as viewed in a longitudinal direction of the core cylinder, is characterized in that a first supporting member provided with the first supporting element and a second supporting member provided with the second supporting element are fixed in opposition to each other by means of a core shaft extending from opposite longitudinal ends of the two supporting members. An arm extending parallel to the axis shaft of the core shaft is pivoted to a midway portion in the longitudinal direction of the two supporting members so as to be swung about a supporting shaft extending in a direction extending at a right angle or orthogonal to the axis of the core shaft. A midway length portion of a third member provided at opposite longitudinal ends thereof with supporting elements is pivoted to such arm by a pivoting shaft extending parallel to the supporting shaft. Energizing means presses the third supporting elements against the inner circumferential surface of the core cylinder.

According to the characteristic constructions of the first and second aspects of the inventions, the supporting shaft can be of reduced weight and can be simply produced by fixedly mounting two supporting members on two short or small size fixing shafts in opposition to each other. The core cylinder of the paper roll is supported at first, second and third circumferentially spaced positions as viewed in the axial direction by means of the three supporting elements of the two supporting members.

According to the characteristic construction of the third aspect of the invention, not only is the core cylinder supported by means of the longitudinal supporting elements of the first and second supporting members contacting internally the inner circumferential surface of the core cylinder, but also the core cylinder is supported by means of the supporting elements of the third supporting member at the two separate positions at opposite longitudinal ends thereof. Thus, the paper roll can be prevented from tilting or swinging in the radial direction of the core cylinder.

DESCRIPTION OF THE PREFERRED EMBODIMENTS

The preferred embodiments of the present invention will be described below with reference to the drawings.

Figure 1:
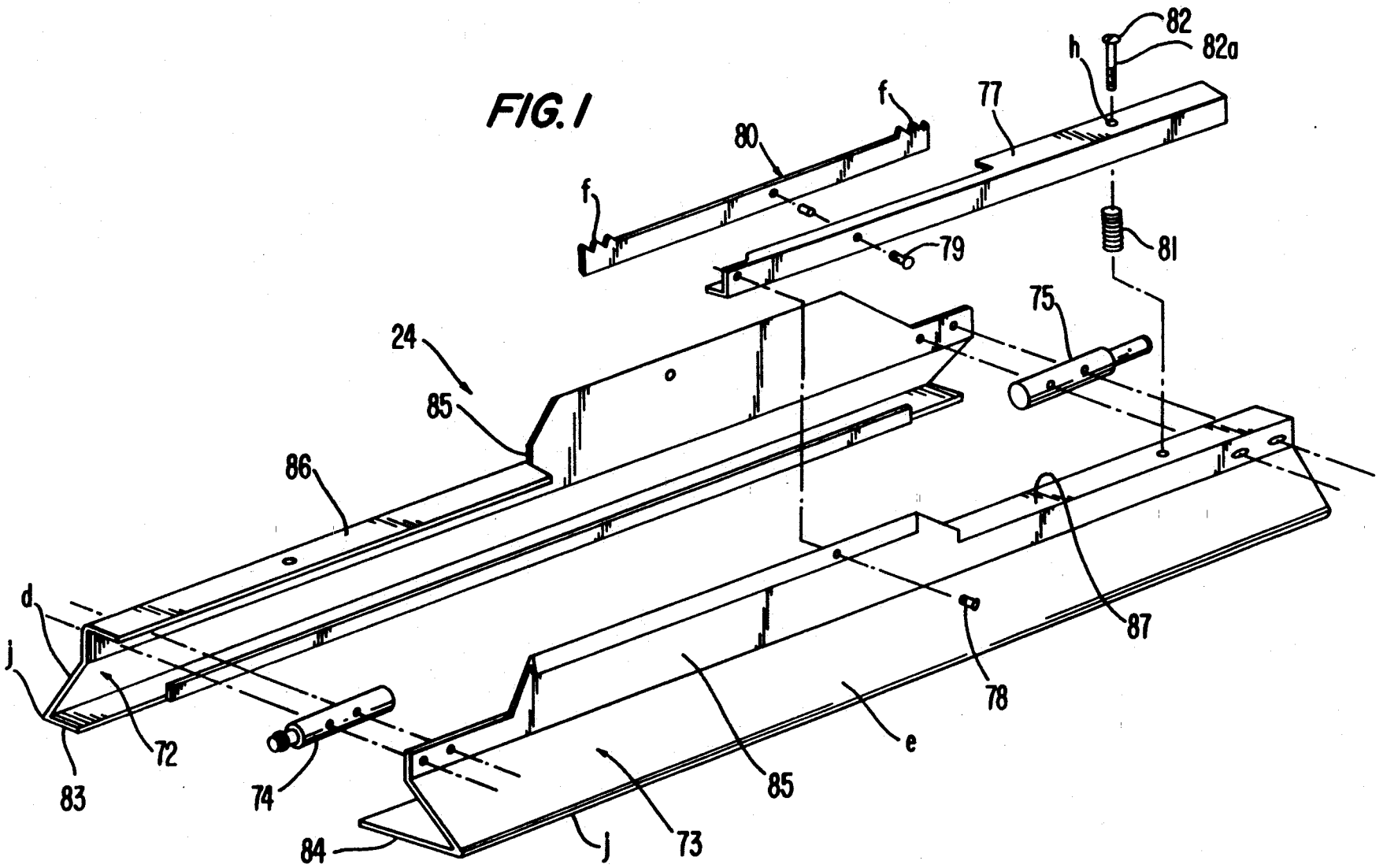
FIG. 1 is an exploded perspective view showing a supporting shaft of a paper roll.
Figure 2:
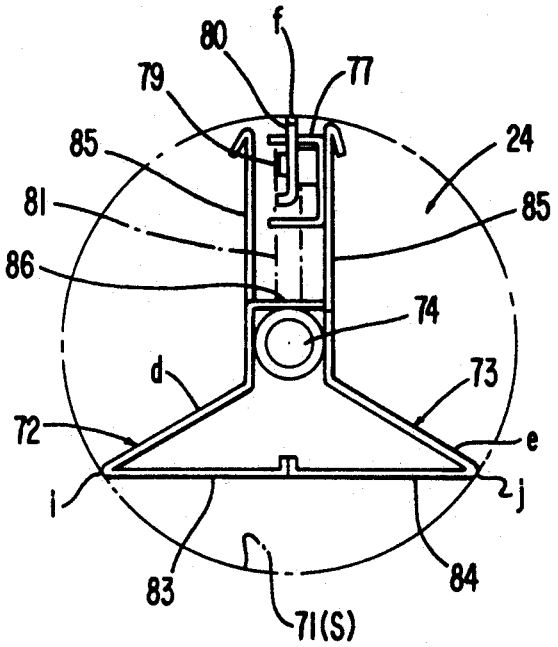
FIG. 2 is an end view of such supporting shaft.
Figure 5:
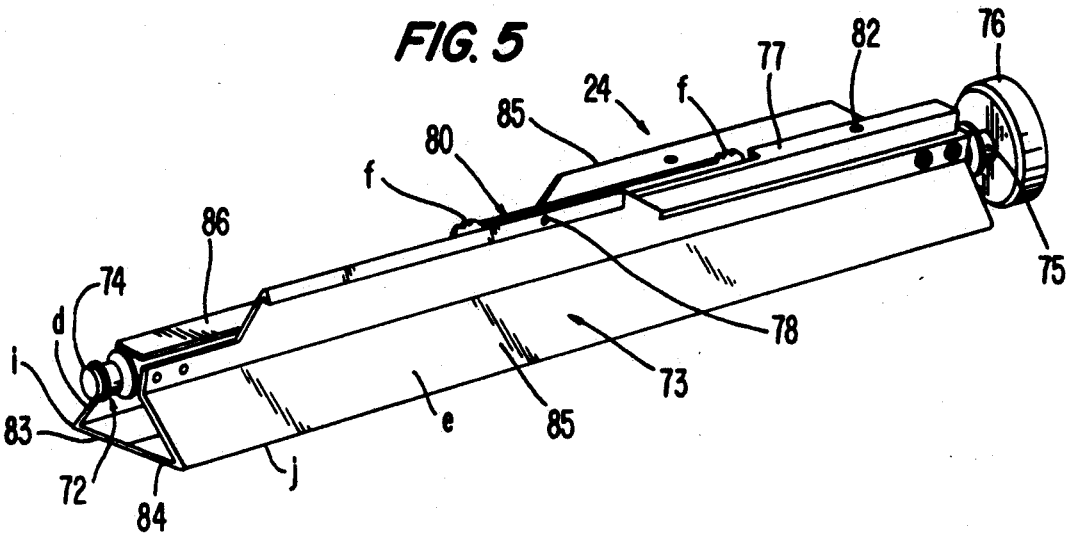
FIG. 5 is a perspective view of such supporting shaft.
Figure 3:
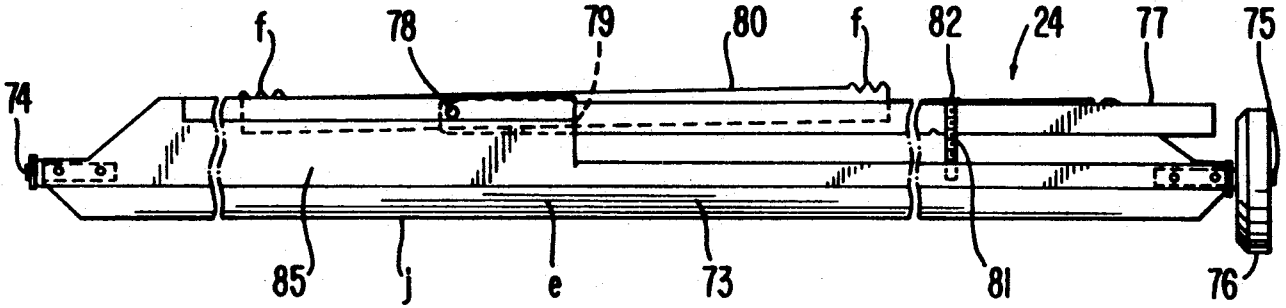
FIG. 3 is a side view of such supporting shaft.
Figure 4:
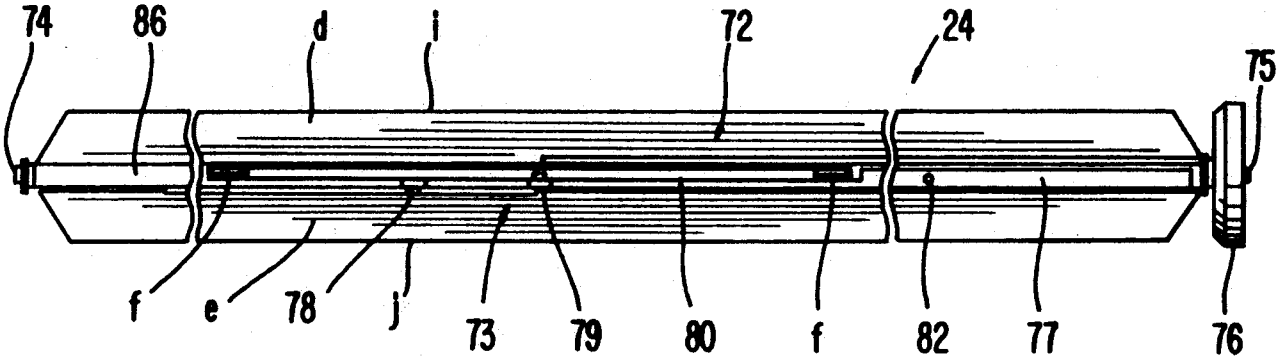
FIG. 4 is a plan view of such supporting shaft.
Figure 6:
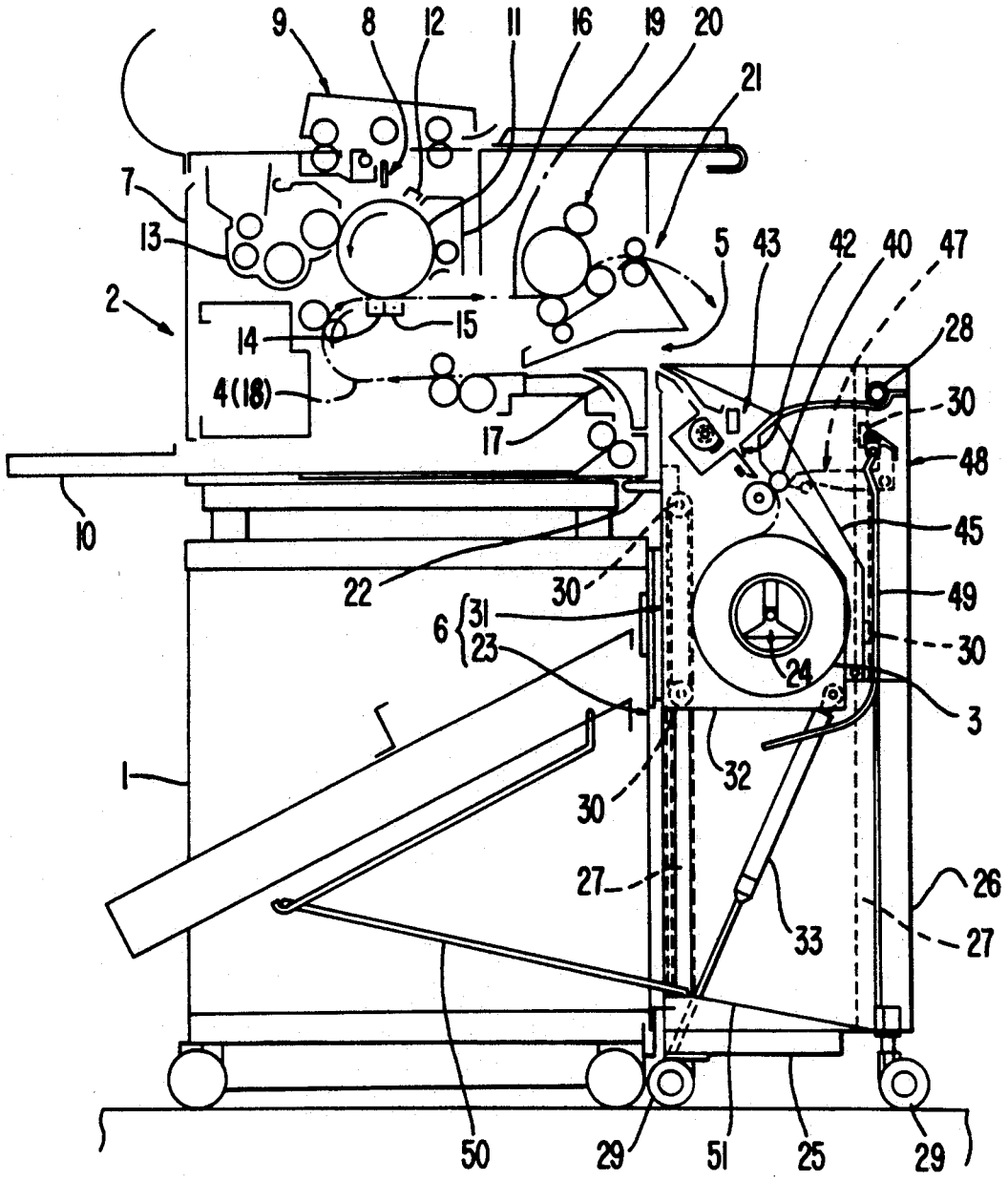
FIG. 6 is a schematic side view of an image forming apparatus employing such supporting shaft.
Figure 7:
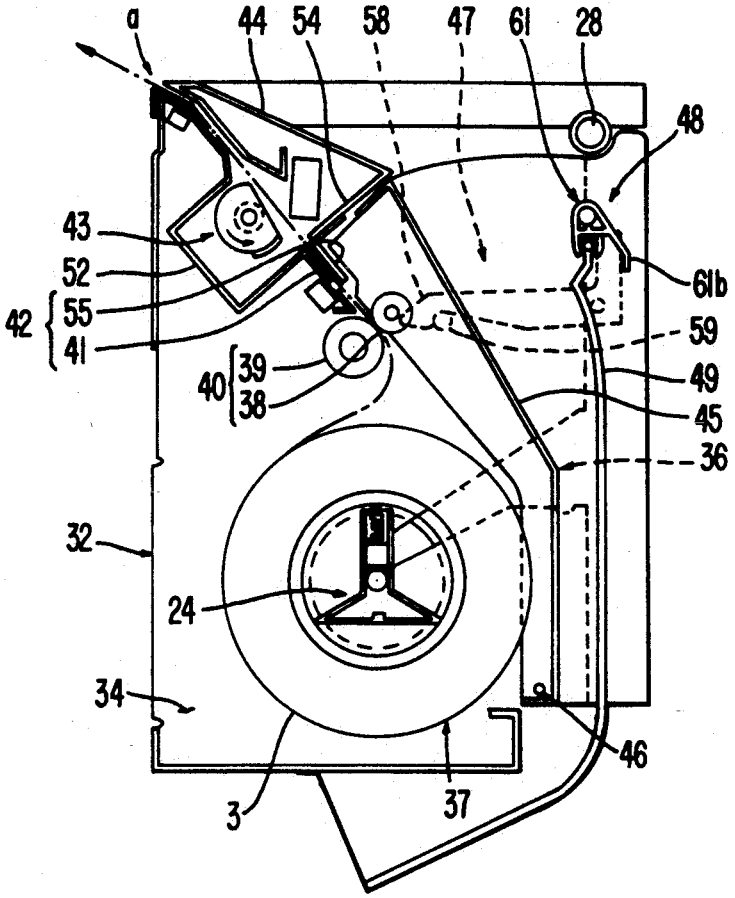
FIG. 7 is a longitudinally sectioned side view showing a body of paper supply unit.
Figure 8:
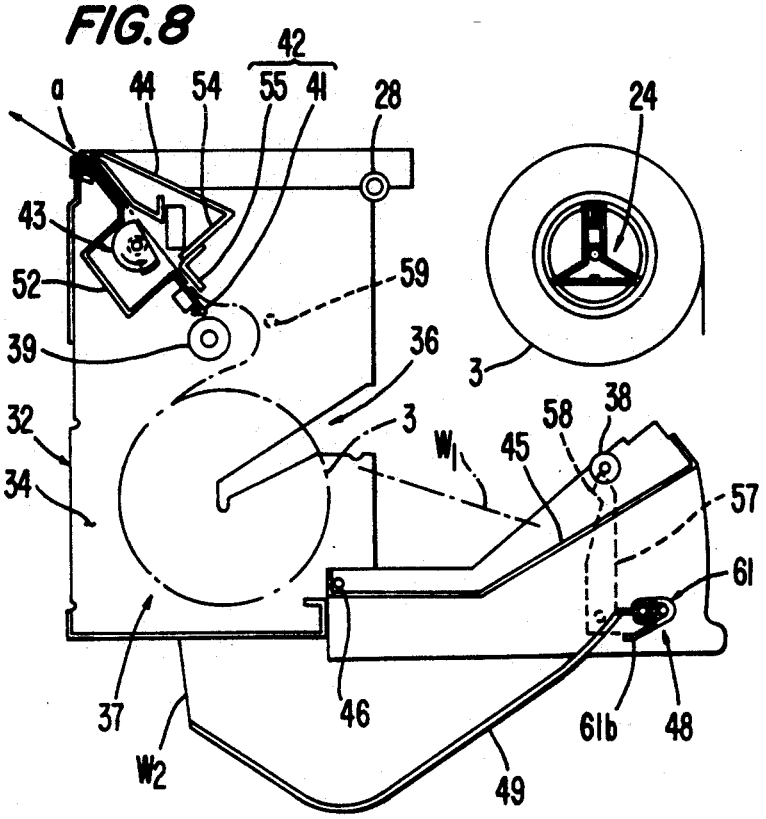
FIG. 8 is a longitudinally sectioned side view of such body with a cover thereof opened.

FIG. 6 is a schematic view showing one example of a copying machine (image forming apparatus) incorporating a construction of a supporting shaft of a paper roll according to the present invention, and FIG. 7 and FIG. 8 are side views showing mounting of a paper roll on a body of paper roll supply unit.

A body 2 of a copying machine is mounted on a movable deck 1. A paper roll supply unit 6 for cutting from a paper roll 3, supporting by means of a supporting shaft 24, cut paper sheets 4 of appointed length is mounted on body 2 to supply sheets 4 to a paper supply port 5 of body 2. In addition, the body 2 is provided with an exposing portion 8, manuscript conveying means 9 in an upper portion of an apparatus case 7 of body 2, and a paper supply cassette 10 for housing large-size regular paper sheets in a lower portion of such apparatus case so as to be freely drawn out toward paper roll supply unit 6. A photoreceptor drum 11 is arranged below exposing portion 8, and a charging device 12, a developing device 13, a transfer device 14, a separating device 15, a cleaning device 16 and the like are arranged along a direction of rotation of photoreceptor drum 11.

Upon starting a transfer operation, a light from exposing portion 8 is reflected by a manuscript, and the resulting reflected light exposes the photoreceptor drum 11. A surface of the photoreceptor drum 11 is uniformly charged by charging device 12, and an electrostatic latent image is formed by the above described exposure. The resulting electrostatic latent image is subjected to a toner development by developing device 13 and then is transferred to a cut paper sheet 4, a regular paper sheet from paper supply cassette 10 and the like (hereinafter referred to as paper sheets 4) by transfer device 14. The paper sheet 4 then is separated from the photoreceptor drum 11 by separating device 15.

A paper guide 17 extends from a paper supply portion of the paper supply cassette 10 to paper supply port 5, and a paper conveying passage 18 extends from the paper supply port 5 to the transfer device of an upstream side thereof in a conveying direction. Thereby, the photoreceptor drum 11 may be supplied with a paper sheet 4 to carry out a transfer operation. A paper discharging and conveying passage 19, a fixing device 20 and paper discharging rollers 21 are provided on a downstream side of separating device 15 in the conveying direction of the paper sheets.

The paper roll supply unit 6 comprises a unit frame 23 mounted by a connecting member 22 on the body 2 adjacent the paper supply port 5, and a body 31 of the paper supply unit mounted to freely ascend and descend relative to unit frame 23. The unit frame 23 comprises vertical frames 26 extending from opposite sides of a bottom frame 25, guide rails 27 provided on opposite sides of vertical frames 26, a tie rod 28 extending over upper end portions of the vertical frames 26, and movable and adjustable casters 29 provided below four corners of bottom frame 25. Body 31 of paper supply unit 6 includes rollers 30 idly engaged guide rails 27 in the vicinities of four upper and lower corners of an ascending and descending frame 32. Energizing means (for example gas springs) 33 are provided on opposite sides and extend from the bottom frame 25 to ascending and descending frame 32 for lifting frame 32 upwardly. Guides 36 for guiding supporting shaft 24 are formed in opposite side plates 34 of frame 32 to form a portion 37 for charging or supplying the paper roll 3 to unit 6, as shown in FIG. 7 and FIG. 8.

Axes of the four upper and lower rollers 30 on the side of or adjacent to the body 2 are directed toward the right and left as viewed in FIG. 6. Thus, unit 6 is prevented from being swung toward and away from body 2. Furthermore, axes of the four upper and lower rollers 30 on the side opposite to the body 2 are directed toward and away from the unit. Thus, unit 6 is prevented from being swung toward the right and left as viewed in FIG. 6.

Holding means 42 holds a leading end of the roll of paper supplied by paper supply roller means 40 in the form of comprising a pair of paper supply rollers 38, 39. A paper supply guide 41 and cutting means 43 for cutting paper sheets from the paper roll 3 in an appointed length at an appointed timing are arranged midway of a paper passage extending from a paper support portion above charging portion 37 to a paper discharging portion (a) directed toward the paper supply port 5 of the body 2. A paper discharging guide plate 44 extends obliquely above an upper side of cutting means 43. A cover 45 also serving as a paper discharging guide is mounted on side plates 34 of frame 32 adjacent portion 37 so as to be swingable between open and closed positions about a supporting shaft 46 mounted on lower portions of plates 34. Paper supply roller 38 supply roller means 40 is mounted on cover 45 at an inner and upper portion thereof, such that the paper passage is located between the body 2 and the paper supply roller 38 and such that roller 38 is idly rotatable. Locking means 47 locks the cover 45 in the closing position thereof, and lock releasing means 48 releases locking means 47 from locking. Reference numeral 49 designates a guide plate forming a paper discharging passage in cooperation with the cover 45. Reference numeral 50 designates a bent guide member arranged within a lower space of movable deck 1. A plate-like tray 51 is connected with a lower side of guide member 50 and is mounted below the unit frame 23. The cover 45 may have formed therein a window (not shown) to enable confirmation of a quantity of paper remaining on a roll 3 within portion 37. Furthermore, guide plate 49 may be formed entirely of a transparent or translucent resinous material so that the quantity of paper remaining on the roll and the passage of paper sheets through the paper discharging passage may be confirmed.

With the above described construction, paper sheets supplied form the paper supply cassette 10, paper sheets manually supplied through the paper supply port 5, or cut paper sheets obtained by cutting from the paper roll 3 and drawn out from the supply unit 6 and supplied to the paper supply port 56 in an appointed timing are discharged from the apparatus through the pair of paper discharging rollers 21 after an image forming operation. Such discharged paper sheets are guided by paper discharging guide plate 44 and through the cover 45 and the guide plate 49 to guide member 50. The leading end of each paper sheet is brought into contact with a bent portion of the bent guide member 50 and a trailing end of the paper sheet falls from the guide plate 49 to the tray 51.

Holding means 42 holding a leading end of paper from the paper roll has the following construction. Paper supply guide plate 41 inclines downwardly from an upstream side of a cutter casing 52 covering a lower portion of cutting means 43. Paper discharging guide plate 44 includes a bracket 54 integrally connected therewith. Bracket 54 has connected therewith holding member 55 for holding the leading end of paper from roll 3 is cooperation with the guide plate 41, with a small paper passage formed between holding member 55 and guide plate 41.

Figure 9A:
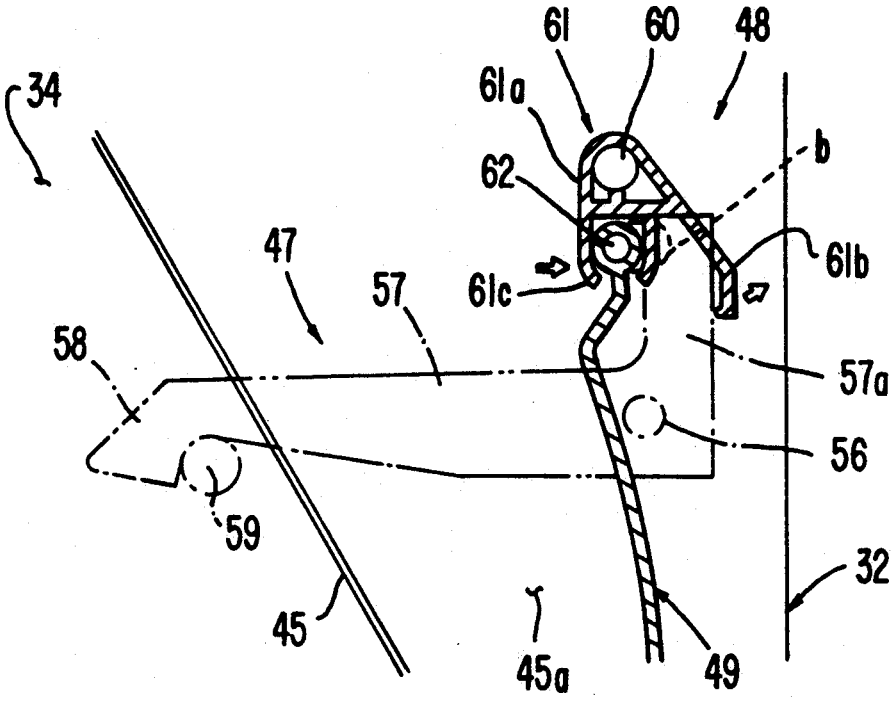
FIGS. 9(*a*) and 9(*b*) are schematic sections showing operations of locking means and lock releasing means.
Figure 9B:
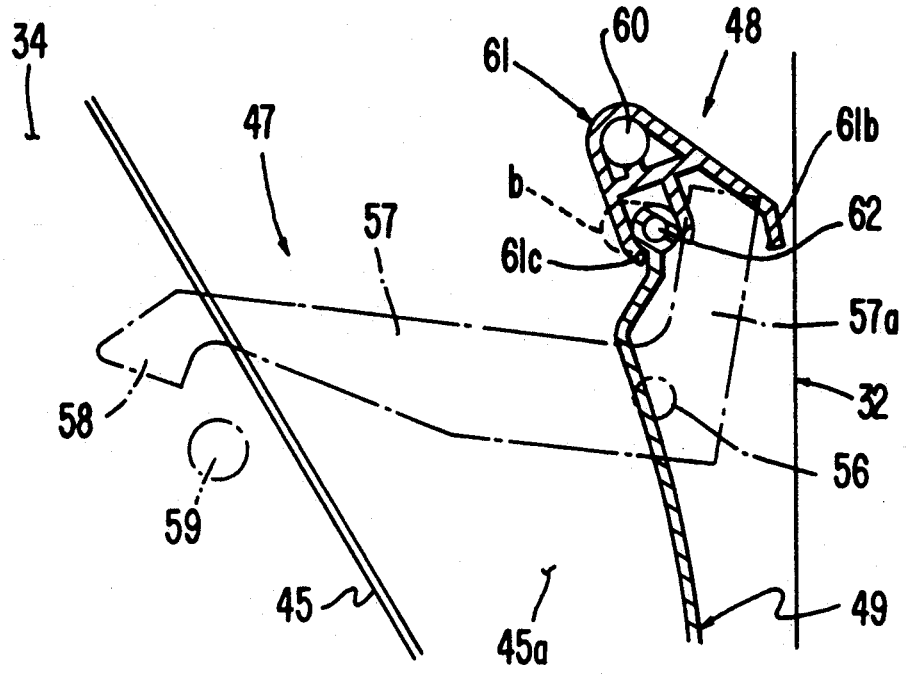

Locking means 47 comprises lock levers 57 pivoted on respective side plates **45*a* of the cover 45 by supporting shafts 56 and engaging pins 59 extending from side plates 34 of frame 32 so as to be engaged by hooks 58 formed at ends of lock levers 57, as shown in FIG. 9**(*a*). Each lock lever 57 is urged to rotate about shaft 56 by a spring (not shown) in a direction such that hook 58 is caused to engage with engaging pin 59 (counterclockwise direction as viewed in FIG. 9(*a*)). Lock releasing means 48 comprises an operating member 61 pivoted about a supporting shaft 60 at a front or outer side (the right side as viewed in FIG. 9(*a*)) of the cover 45. A lock releasing shaft 62 is inserted through elongated holes (b) formed in side plates **45*a* of the cover 45 and serves also as a supporting shaft for the guide plate 49. Operating member 61 includes a body 61*a* through which extends supporting shaft 60, a handle 61*b* projected from a front side of body 61*a*, and a shaft holding portion 61*c* provided below the body 61*a* for rotatably holding or retaining lock releasing shaft 62. Although not shown, the operating member 61 has a length extending over the entire width of the cover 45. Lock releasing shaft 62 is held at the major central portion thereof by shaft holding portion 61*c* of the operating member 61. Opposite end portions of shaft 62 project through holes (b) from the side plates 45*a* of the cover 45 and are engaged with side surfaces of riser members 57*a* of the lock levers 57 arranged on opposite sides of the cover. Lock levers 57 press the lock releasing shaft 62 against inner sides (left side as shown in FIG. 9**(*a*)) of the holes (*b*). Thus, the lock releasing shaft 62 and the operating member 61 can be prevented from vibrating or rattling during times when the operating member 61 is not being operated.

The lock is released by lock releasing means 48 in the following manner.

First, handle **61*b* is pulled (as shown by the right arrow in FIG. 9**(*a*)) toward the right in FIG. 9(*a*), thus causing the operating member 61 to rotate about shaft 60 in the direction shown by the left arrow in FIG. 9(*a*). Thereupon, the lock releasing shaft 62 held by the shaft holding portion **61*c* of the operating member 61 is moved toward the front of the cover 45, i.e. along the holes (b), as shown in FIG. 9**(*b*). This causes lock levers 57 to rotate in a clockwise direction about shaft 56 against the energizing force of the spring (not shown). The supporting shaft 60 is a pivot or center of movement of the lock releasing shaft 62. As shown in FIG. 9(*b*), the engagement of the hooks 58 of the lock levers 57 with the engaging pins 59 is released, thereby unlocking the cover 45. Subsequently, if the cover 45 is rotated about supporting shaft 46 to the open position shown in FIG. 8, the charging portion 37 is opened widely. Thus, an operation of exchanging the paper roll 3 in the charging portion 37 can be conducted easily. Insertion of a leading end of the paper roll 3 between the paper supply guide plate 41 and holding member 55 easily can be achieved since the paper is curled somewhat. Accordingly, the leading end of the paper can be prevented from sliding off the inclined paper supply guide plate 41 until the cover 45 is closed. Thus, the leading end of the paper surely can be positioned between the roller 38 and the roller 39, and the exchanged paper roll 3 surely can be brought into a paper supply posture by merely closing the cover 45.

Reference W1 designates a wire for regulating the extent of rotation of the cover 45 about shaft 46 and supporting the opened cover 45. Reference W2 designates a wire for suspending a lower end of the guide plate 49 when the cover 45 is opened.

Figure 10:
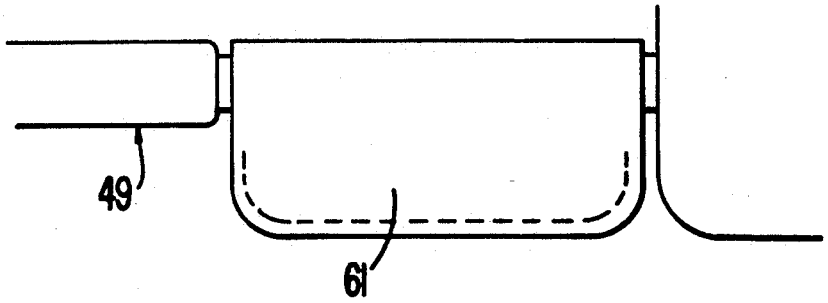
FIGS. 10(*a*), 10(*b*) and 10(*c*) are schematic views of another preferred embodiment of lock releasing means.
Figure 10:
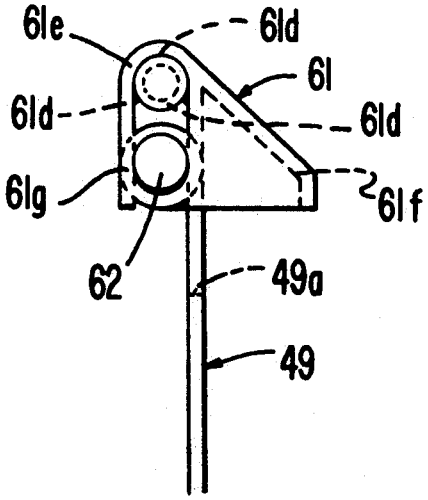
Figure 10:
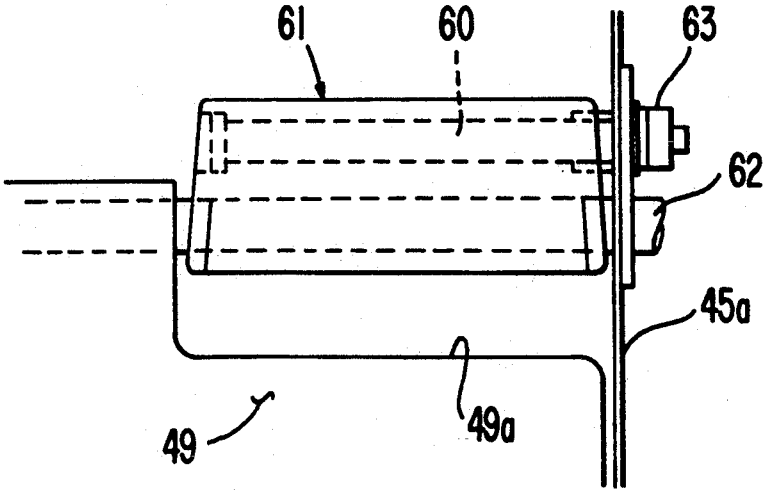

The above embodiment provides that the operating member 61 of the lock releasing means 48 extends over the entire width of the cover 45. However, shorter operating members 61, the length of each of which is shorter than the width of the cover, may be arranged in notched portions **49*a* formed in upper end portions of the guide plate 49 at opposite sides or ends of the cover 45, as shown in FIG. 10**(*a*) to 10(*c*). This operating member 61 comprises a body **61*e* rotatably supported by ribs 61*d* a respective supporting shaft 60 fixedly mounted on the respective side plate 45*a* of the cover 45 by means of a nut 63. Ribs 61*d* contact an outer circumference of the supporting shaft 60 from three directions. A handle 61*f* projects from a front surface of body 61*e*. A shaft holding portion 61*g*** provided below the body 61*e* holds or retains for rotation and upward and downward movement the lock releasing shaft 62.

Figure 11:
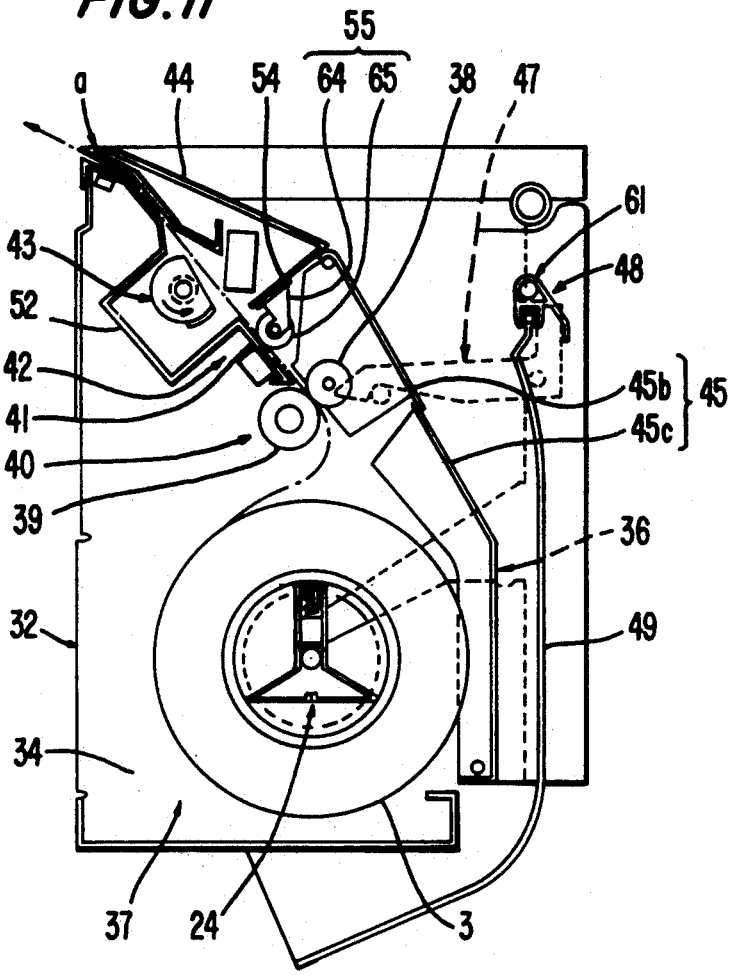
FIG. 11 is a longitudinally sectioned side view of a body of a paper supply unit showing another preferred embodiment of means for holding a leading end of a paper roll.

The holding means 42 holding a leading end of paper from the paper roll may be modified as follows. Thus, as shown in FIG. 11, the cover 45 is divided into an upper cover portion 45*b* and a lower cover portion 45*c*. The paper supply roller 38 is idly mounted on upper cover portion 45*b*. The upper cover portion 45*b* is pivoted on bracket 54. An arm 64 provided with an idler roller 65 form holding member 55 for holding a leading end of the paper. Holding member 55 is mounted on the bracket 54 such that idler roller 65 is brought into contact with the paper supply guide plate 41.

Next, a concrete construction of paper roll supporting shaft 24 will be described with reference to FIGS. 1 to 5.

Supporting shaft 24 includes a first supporting member 72 provided with a first supporting element (d) brought into contact at a bend (i) with an inner circumferential surface S of a core cylinder 71 of the paper roll 3. Such contact extends in the longitudinal direction. A second supporting member 73 is provided with a second supporting element (e) brought into contact at a bend (j) with the inner circumferential surface S of core cylinder 71. Such contact extends in the longitudinal direction. Members 72, 73 have fixedly mounted on opposite ends thereof small size spindles or core shafts 74, 75, e.g. by means of screws or the like at both end portions thereof. Members 72, 73 are mounted in opposition to each other. End portions of shafts 74, 75 project from the opposite end portions of both supporting members 72, 73, so as to be rotatably supported on inserting guides 36. Shaft 75 is provided with a brake 76 that also serves as a handle. Shafts 74, 75 together have a longitudinal dimension much less than that of members 72, 73, such that a major portion of the longitudinal dimension of members 72, 73 is not supported by shafts 74, 75.

An arm 77 extends parallel to the direction of the axis of shafts 74, 75 and is pivoted to both supporting members 72, 73 at a position midway of the length thereof or between opposite ends thereof so as to be pivotable about a supporting shaft 78 extending at a right angle or orthogonal to the axis of shafts 74, 75. A midway portion of a third supporting member 80, provided with saw-toothed third supporting elements (f) at opposite longitudinal ends thereof, is pivotally connected with arm 77 by a pivoting shaft 79 extending parallel to supporting shaft 78. Energizing means 81 urges arm 77 outwardly about shaft 78 and thereby urges third supporting elements (f) outwardly against the inner circumferential surface S of the core cylinder 71. Means 81 is provided between the second supporting member 73 and the arm 77. Reference numeral 82*a* designates a screw screwed into a second regulating element 87 (to be described in more detail below) of second supporting member 73 and extending through a hole (h) formed in the arm 77. The diameter of hole (h) is smaller than that of a head 82 of screw 82*a*, so that swing movement of the arm 77 outwardly as a result of the force of energizing means 81 will be regulated or limited by engagement of the arm 77 with screw head 82. Thus, the screw head 82 forms a swing regulating member regulating the extent of outward swinging movement of the arm 77.

The first and second supporting members 72, 73 have the same identical shape. The first supporting element (d) of the first supporting member 72 is bent at first contact portion (i) to form a first extended portion 83 extending toward the second contact portion (j) of second supporting element (e). Second supporting element (e) of the second supporting member 73 is bent at second contact portion (j) to form a second extended portion 84 extending toward the first contact portion (i) of first supporting element (d). Adjacent outer ends of first extended portion 83 and second extended portion 84 are bent toward the shafts 74, 75. Such bent ends are engaged with each other.

The first and second supporting members 72, 73 each have bent and extending therefrom at a bending angle, for example 120°, a respective arm supporting member or portion 85. A first regulating element 86 is bent and extends from supporting member 72 toward member 85 of the second supporting member 73 and via shaft 74 is fixedly connected thereto. Second regulating element 87 is bent and extends from supporting member 73 toward member 85 of the first supporting member 72 and via shaft 75 is fixedly connected therewith. Elements 86 and 87 extend from opposite ends of the structure. Thus, shafts 74, 75 are mounted at opposite ends between members 72, 73 and elements 86, 87, respectively.

In addition, the position of pivotal mounting of the third supporting member 80 by pivoting shaft 79 may be shifted slightly in the direction of extension of the arm 77, such that the leading end of the third supporting member 80 (in the direction of insertion into the core cylinder 71) may be moved freely inwardly due to an imbalance of weight.

With the above described construction, the core shafts 74, 75 fixedly mounting the first and second supporting members 72, 73 are of small size, and specifically are of relatively short length. Thus, weight can be reduced. Also, both supporting members 72, 73 have the same identical shape, so that the number of parts required can be substantially reduced. Thereby, costs can be reduced. In addition, the extended portions 83, 84 and the arm supporting members 85 are bent from and connected with the first and second supporting members 72, 73, respectively. Also, the extended portions 83, 84 are engaged with each other. As a result, the first and second supporting members 72, 73 will have improved rigidity and jamming and the like resulting from vibration of the paper roll 3 can be prevented. Thereby, paper from the roll 3 will be supplied stably. Furthermore, the regulating elements 86, 87 are integral bent extensions connected with and extending from supporting members 72, 73, respectively, and shafts 74, 75 are engaged with the regulating elements 86, 87, respectively. Thus, both supporting members 72, 73 and the shafts 74, 75 can be mounted simply.

When the roll paper support shaft 24 is to be inserted into or withdrawn from the core cylinder 71, the pivoting shaft 79 of the third supporting member 80 must be moved inwardly to remove the supporting elements (f) of the third supporting member 80 from the inner circumferential surface S of the core cylinder 71. This is done by moving the free end of arm 77 toward shaft 75 against the force of the energizing means 81. The supporting shaft 24 then can be simply inserted into or withdrawn from the core cylinder 71 of the paper roll 3 since the third supporting member 80 is moved inwardly with shaft 79.

Upon releasing the arm 77 after the supporting shaft 24 is inserted into the core cylinder 71, the arm 77 is swung outwardly toward the swing regulating member 82 around the supporting shaft 78 by the force of the energizing means 81. Such force is applied to the pivoting shaft 79 through the arm 77, whereby the supporting elements (f) of the third supporting member 80 swingable around the pivoting shaft 79 are pressed against the inner circumferential surface S of the core cylinder 71. Thereby, the supporting elements (d), (e) of the first and second supporting members 72, 73 also are pressed against the inner circumferential surface S of the core cylinder 71 throughout the entire longitudinal length of elements (d), (e).

The paper roll 3 can be surely prevented from being swung in the radial direction due to the fact that the core cylinder is supported by the longitudinal elements supporting (d), (e) of the first and second supporting members 72, 73, as well as at two longitudinally spaced positions by the third supporting member 80. As a result, paper can be drawn out stably from roll 3.

Although the third supporting elements (f) are partially formed on opposite longitudinal ends of the third supporting member 80, an additional third supporting element also may be provided at a central longitudinal portion of the third supporting member 80, or the third supporting element (f) may be provided to extend over the entire longitudinal length of the third supporting member 80.

Also, the supporting elements (d), (e) of the first and second supporting members 72, 73 may be modified to be tooth in shape to contact intermittently in the longitudinal direction the inner circumferential surface S of the core cylinder 71.

Figure 12:
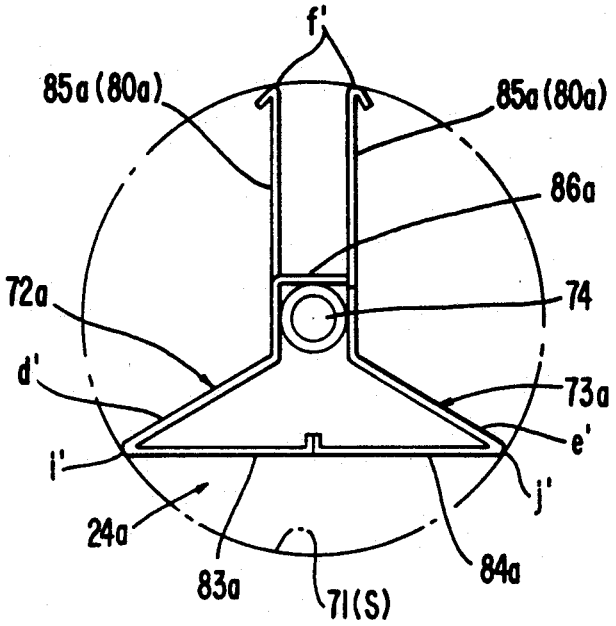
FIG. 12 is an end view showing another preferred embodiment of a supporting shaft of a paper roll.

Although the arm 77 is pivoted on the first and second supporting members 72, 73 and the third supporting member 80 provided with the third supporting elements (f) is pivoted on the arm 77 to achieve the first and second inventions in the above described preferred embodiment, the arm 77 and the third supporting member 80 may be omitted. In such case members **85*a* integral with and bent from the first and second supporting members 72*a*, 73*a* may be used to form third supporting members 80*a*, and outer end edges of the third supporting members 80*a*, may form third supporting elements (f') internally contacting the inner circumferential surface S of the core cylinder 71, as shown in FIG. 12**, in order to achieve the second invention.

Figure 14:
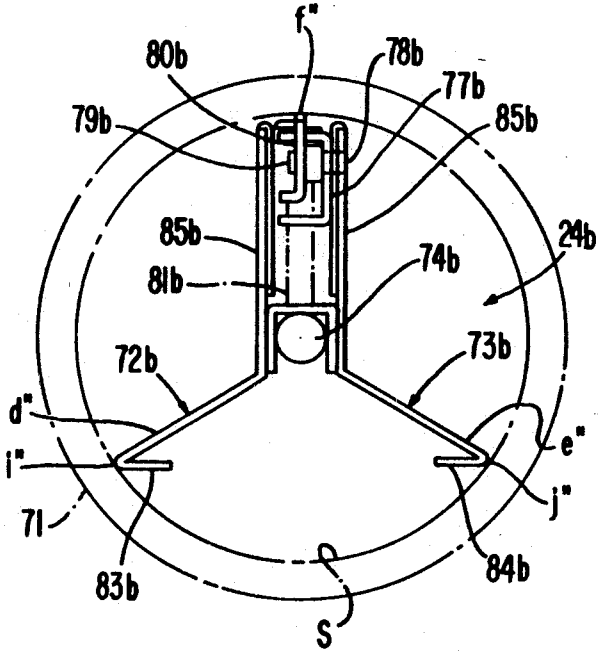
FIG. 14 is an end view of the supporting shaft of FIG. 13.
Figure 13:
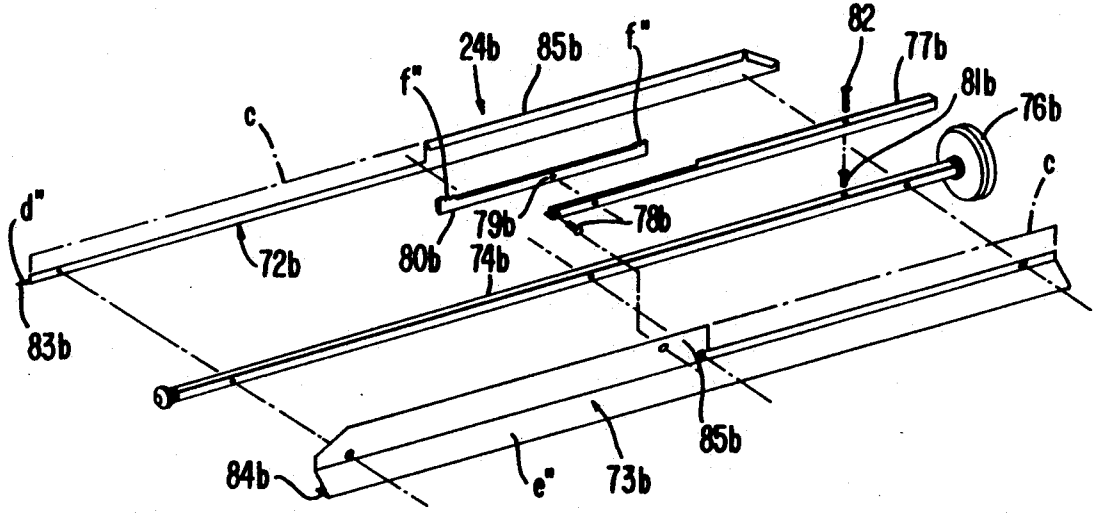
FIG. 13 is an exploded perspective view showing a further preferred embodiment of a supporting shaft of a paper roll.
Figure 15:
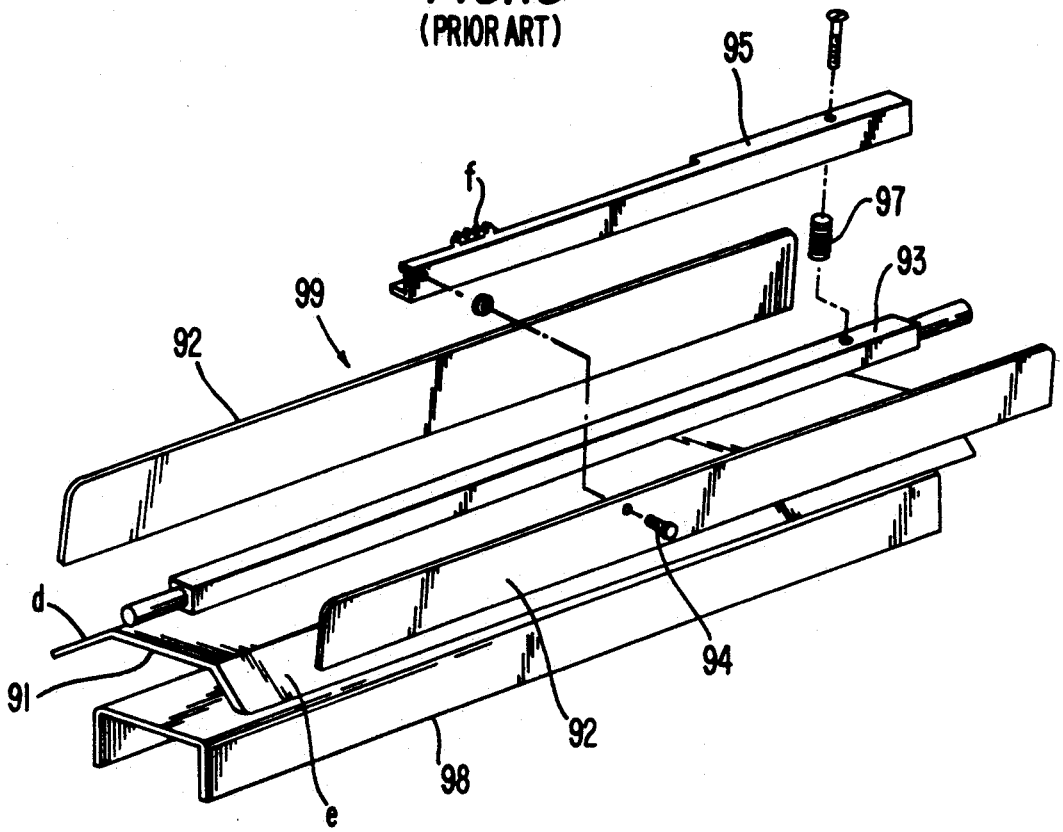
FIG. 15 (PRIOR ART)
FIG. 15 is an exploded perspective view showing a conventional supporting shaft of a paper roll.
Figure 16:
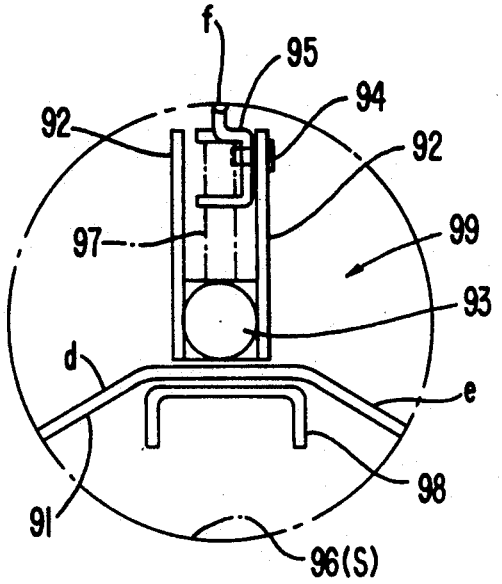
FIG. 16 (PRIOR ART)
FIG. 16 is an end view of such conventional supporting shaft.

Further, although the first and second supporting members 72, 73 are fixedly mounted on the relatively short, small size shafts 74, 75, the third invention can be achieved by replacing the short shafts 74, 75 with a single shaft **74*b* extending throughout the length of the structure, with the first and second supporting members 72*b*, 73*b* being fixedly mounted on such single shaft 74*b*, as shown in FIG. 13. In such embodiment, as shown also in FIG. 14, first supporting member 72*b* provided with first supporting element (d'') contacts internally the inner circumferential surface S of the core cylinder 71 in the longitudinal direction, and second supporting member 73*b*, having the same one shape as that of the first supporting member 72*b* and provided with the second supporting element (e'') contacts internally the inner circumferential surface S of the core cylinder 71 in the longitudinal direction. Members 72*b*, 73*b* are fixedly mounted on single shaft 74*b* by means of screws or the like in opposition to each other so that end portions of the shaft 74*b* project from opposite end portions of supporting members 72*b*, 73*b*. A brake 76*b* serving also as a handle is provided on one longitudinal end of shaft 74*b*. Arm 77*b* extending parallel to the axis of shaft 74*b* is pivoted about shaft 78 to a midway position between the ends of supporting members 72*b*, 73*b* Arm 77*b*, is swingable about shaft 78*b* that extends at a right angle or orthogonal to the axis of shaft 74*b*. A midway length portion of third supporting member 80*b* provided with saw-toothed third supporting elements (f'') on opposite longitudinal ends thereof is pivotally connected with arm 77*b*, at a position adjacent but longitudinally spaced from shaft 78*b*, by pivoting shaft 79 extending parallel to shaft 78*b*. Energizing means 81 presses arm 77*b* outwardly, thereby pressing third supporting elements (f'') against the inner circumferential surface S of the core cylinder 71. Means 81*b* is provided between the second supporting member 73*b* and the arm 77**.

First supporting element (d'') of first supporting member **72*b* is bent at first contact portion (i'') to form a first extended portion 83*b* extending toward a second contact portion (j'') of second supporting element (e''). Second supporting element (e''), of second supporting member 73 is bent at second contact portion (j'') against surface S to form a second extended portion 84*b* extending toward first contact portion (i). An arm support member 85*b* is integral with and bent to extend from each of the first and second supporting members 72*b*, 73*b* at a bending angle of for example 120°. Nearly half of each member 85*b*, in the longitudinal direction thereof, is removed as shown at (a). Although in the embodiment of FIG. 1 the first and second extended portions 83, 84 are bent at the free ends thereof and such bent ends are in engagement with each other, and the first and second supporting members 72, 73 are provided with the first and second regulating pieces 86, 87, respectively, in the embodiment of FIG. 13 the extended portions 83*b*, 84*b*, are of reduced length and do not abut, and the first and second regulating pieces 86, 87** are omitted.

The present invention of the above described constructions has the following effects. Thus, according to the first and second inventions, the core shafts or spindles fixedly mounting the first and second supporting members are short and of small size. Therefore, not only is the weight of the paper roll supporting shaft reduced, but also assembly is improved and the cost of production is reduced.

According to the third invention, the core cylinder is supported not only by the first and second supporting members contacting internally the inner circumferential surface of the core cylinder, but also at the two separate positions spaced in the longitudinal direction of the third supporting member. Thus, opposite ends of the paper roll can be prevented from tilting or swinging in the radial direction. As a result, paper can be supplied from the paper roll ideally in an intended manner without the problem of inaccurate paper supply such as oblique paper supply.

What is claimed is:

1. In a supporting shaft for supporting a paper roll and including first, second and third supporting elements for contacting internally an internal circumferential surface of a core cylinder of the paper roll at three respective circumferentially spaced locations thereof as viewed axially thereof, the improvement comprising:

a first supporting member having opposite longitudinal ends and defining said first supporting element;

a second supporting member having opposite longitudinal ends and defining said second supporting element;

coaxial first and second spindles each having a length less than that of said first and second supporting members;

said first and second supporting members being mounted in opposition to each other with first adjacent longitudinal ends of said first and second supporting members being fixedly mounted on said first spindle, and with second adjacent longitudinal ends of said first and second supporting members being fixedly mounted on said second spindle;

a longitudinal arm pivoted to said first and second supporting members at a position midway between said opposite longitudinal ends thereof; and a third supporting member having thereon said third supporting element and pivoted to said arm.

2. The improvement claimed in claim 1, wherein said first and second supporting members have the same identical shape.

3. The improvement claimed in claim 2, wherein said first supporting element is bent to define a first contact portion to contact the inner circumferential surface of the core cylinder and to form a first extended portion, said second supporting element is bent to define a second contact portion to contact the inner circumferential surface of the core cylinder and to form a second extended portion, said first and second extended portions extending toward each other and having free end portions in engagement with each other.

4. The improvement claimed in claim 3, wherein said free end portions are bent and extend generally transverse to said extended portions.

5. The improvement claimed in claim 3, wherein said first and second contact portions extend longitudinally parallel to coaxial axes of said spindles.

6. The improvement claimed in claim 2, wherein said first supporting member includes, adjacent said first longitudinal end thereof, an integral first regulating element engaged with said first spindle, and said second supporting member includes, adjacent said second longitudinal end thereof, an integral second regulating element engaged with said second spindle.

7. The improvement claimed in claim 6, wherein said first regulating element is bent from said first supporting member and extends toward said second supporting member, and said second regulating element is bent from said second supporting member and extends toward said first supporting member.

8. The improvement claimed in claim 7, wherein said first and second regulating members are aligned coplanar.

9. The improvement claimed in claim 6, wherein said first supporting member includes, adjacent said second longitudinal end thereof, a first supporting portion, said second supporting member includes, adjacent said first longitudinal end thereof, a second supporting portion, and said first and second supporting portions support said longitudinal arm.

10. The improvement claimed in claim 9, wherein said first regulating member is inclined relative to said first supporting portion and extends toward said second supporting portion, and said second regulating member is inclined relative to said second supporting portion and extends toward said first supporting portion.

11. The improvement claimed in claim 10, wherein said first regulating member abuts said second supporting portion, and said second regulating member abuts said first supporting portion.

12. The improvement claimed in claim 9, wherein said longitudinal arm is pivoted to said first and second supporting portions.

13. The improvement claimed in claim 12, wherein said arm extends parallel to coaxial axes of said spindles and is pivoted about a supporting shaft extending transverse to said axes, and said third supporting member is pivoted at a mid-length portion thereof to said arm about a pivoting shaft extending parallel to said supporting shaft.

14. The improvement claimed in claim 13, wherein said third supporting element comprises portions located at opposite axial ends of said third supporting member and adapted to be brought into contact with the internal circumferential surface of the core cylinder as a result of outward movement of said pivoting shaft due to outward pivoting of said arm about said supporting shaft.

15. The improvement claimed in claim 14, further comprising means provided between said arm and one of said regulating members for urging said arm to pivot outwardly about said supporting shaft.

16. The improvement claimed in claim 11, wherein said arm extends parallel to coaxial axes of said spindles and is pivoted about a supporting shaft extending transverse to said axes, and said third supporting member is pivoted at a mid-length portion thereof to said arm about a pivoting shaft extending parallel to said supporting shaft.

17. The improvement claimed in claim 16, wherein said third supporting element comprises portions located at opposite axial ends of said third supporting member and adapted to be brought into contact with the internal circumferential surface of the core cylinder as a result of outward movement of said pivoting shaft due to outward pivoting of said arm about said supporting shaft.

18. The improvement claimed in claim 17, further comprising means for urging said arm to pivot outwardly about said supporting shaft.

19. In a supporting shaft for supporting a paper roll and including first, second and third supporting elements for contacting internally an internal circumferential surface of a core cylinder of the paper roll at three respective circumferentially spaced locations thereof as viewed axially thereof, the improvement comprising:

a first supporting member having opposite longitudinal ends and defining said first supporting element;

a second supporting member having opposite longitudinal ends and defining said second supporting element;

structure defining opposite first and second longitudinally spaced coaxial spindle portions;

said first and second supporting members being mounted in opposition to each other by being fixedly mounted to said spindle portions defining structure;

a longitudinal arm extending parallel to coaxial axes of said spindle portions and pivoted to said first and second supporting members, at a position between said opposite ends thereof, about a supporting shaft extending transverse to said axes;

a third supporting member pivoted at a midlength portion thereof to said arm about a pivoting shaft extending parallel to said supporting shaft;

said third supporting element including axially spaced portions located at opposite axial ends of said third supporting member; and means for urging said arm to pivot outwardly about said supporting shaft, thereby moving said pivoting shaft outwardly and enabling said portions of said third supporting element to be brought into contact with the inner circumferential surface of the core cylinder.

20. The improvement claimed in claim 19, wherein said spindle portions defining structure comprises a single shaft extending throughout the entire axial length of said first and second supporting members and having opposite axial ends extending beyond respective ends of said first and second supporting members.

21. The improvement claimed in claim 20, wherein said urging means is positioned between said single shaft and said arm.

22. The improvement claimed in claim 19, wherein said first and second supporting members have the same identical shape.

23. The improvement claimed in claim 22, wherein said first supporting element is bent to define a first contact portion to contact the inner circumferential surface of the core cylinder and to form a first extended portion, said second supporting element is bent to define a second contact portion to contact the inner circumferential surface of the core cylinder and to form a second extended portion, said first and second extended portions extending toward each other and having free end portions spaced from each other.

24. The improvement claimed in claim 23, wherein said first and second contact portions extend longitudinally parallel to coaxial axes of said spindle portions.

25. The improvement claimed in claim 22, wherein said first supporting member includes, adjacent a second longitudinal end thereof, a first supporting portion, said second supporting member includes, adjacent a first longitudinal end thereof, a second supporting portion, and said first and second supporting portions support said third supporting element.

26. The improvement claimed in claim 19, wherein said spindle portions defining structure comprises axially spaced separate first and second spindles each having a length less than that of said first and second supporting members, first adjacent longitudinal ends of said first and second supporting members being fixedly mounted on said first spindle, and second adjacent longitudinal ends of said first and second supporting members being fixedly mounted on said second spindle.

27. The improvement claimed in claim 26, wherein said first and second supporting members have the same identical shape.

28. The improvement claimed in claim 27, wherein said first supporting element is bent to define a first contact portion to contact the inner circumferential surface of the core cylinder and to form a first extended portion, said second supporting element is bent to define a second contact portion to contact the inner circumferential surface of the core cylinder and to form a second extended portion, said first and second extended portions extending toward each other and having free end portions in engagement with each other.

29. The improvement claimed in claim 28, wherein said free end portions are bent and extend generally transversely to said extended portions.

30. The improvement claimed in claim 28, wherein said first and second contact portions extend longitudinally parallel to said coaxial axes of said spindles.

31. The improvement claimed in claim 27, wherein said first supporting member includes, adjacent said first longitudinal end thereof, an integral first regulating element engaged with said first spindle, and said second supporting member includes, adjacent said second longitudinal end thereof, an integral second regulating element engaged with said second spindle.

32. The improvement claimed in claim 31, wherein said first regulating element is bent from said first supporting member and extends toward said second supporting member, and said second regulating element is bent from said second supporting member and extends toward said first supporting member.

33. The improvement claimed in claim 32, wherein said first and second regulating members are aligned coplanar.

34. The improvement claimed in claim 31, wherein said first supporting member includes, adjacent said second longitudinal end thereof, a first supporting portion, said second supporting member includes, adjacent said first longitudinal end thereof, a second supporting portion, and said first and second supporting portions support said third supporting element.

35. The improvement claimed in claim 34, wherein said first regulating member is inclined relative to said first supporting portion and extends toward said second supporting portion, and said second regulating member is inclined relative to said second supporting portion and extends toward said first supporting portion.

36. The improvement claimed in claim 35, wherein said first regulating member abuts said second supporting portion, and said second regulating member abuts said first supporting portion.

37. The improvement claimed in claim 34, wherein said regulating member and said supporting portion of each said supporting member are of approximately the same longitudinal length.

38. The improvement claimed in claim 31, wherein said urging means is provided between said arm and one of said regulating members.

39. The improvement claimed in claim 19, further comprising means for restricting the extent of movement of said arm outwardly about said supporting shaft.

40. The improvement claimed in claim 19, wherein said axially spaced portions of said third supporting element are sawtooth shaped.

* * * * *